US010167587B2

(12) United States Patent
Biancalani et al.

(10) Patent No.: US 10,167,587 B2
(45) Date of Patent: Jan. 1, 2019

(54) METHOD AND MACHINE FOR TREATING TEXTILE FABRICS WITH AN ADJUSTABLE AIR FLOW

(71) Applicant: BIANCALANI S.R.L., Prato (IT)

(72) Inventors: Massimo Biancalani, Prato (IT); Riccardo Ravagli, Pistoia (IT)

(73) Assignee: BIANCALANI S.R.L., Prato (IL)

( * ) Notice: Subject to any disclaimer, the term of this patent is extended or adjusted under 35 U.S.C. 154(b) by 182 days.

(21) Appl. No.: 15/123,405

(22) PCT Filed: Mar. 5, 2015

(86) PCT No.: PCT/IB2015/051626

§ 371 (c)(1),
(2) Date: Sep. 2, 2016

(87) PCT Pub. No.: WO2015/132757

PCT Pub. Date: Sep. 11, 2015

(65) Prior Publication Data

US 2017/0067196 A1 Mar. 9, 2017

(30) Foreign Application Priority Data

Mar. 5, 2014 (IT) ..... PO2014A0001

(51) Int. Cl.
*D06B 3/28* (2006.01)
*D06C 19/00* (2006.01)
(Continued)

(52) U.S. Cl.
CPC ..... *D06B 3/28* (2013.01); *B65H 20/14* (2013.01); *D06C 19/00* (2013.01); *F26B 13/103* (2013.01)

(58) Field of Classification Search
CPC ..... D06F 3/28; D06C 19/00; F26B 13/103; B65H 20/14
See application file for complete search history.

(56) References Cited

U.S. PATENT DOCUMENTS 5,845,355 A * 12/1998 Strahm ..... D06B 3/28 8/152
5,850,651 A * 12/1998 Ishimaru ..... D06B 3/28 8/152

(Continued)

FOREIGN PATENT DOCUMENTS

DE 10 2005 034579 A1 2/2007
EP 2535451 A1 12/2012

(Continued)

*Primary Examiner* — Joseph L. Perrin
(74) *Attorney, Agent, or Firm* — McGlew and Tuttle, P.C.

(57) ABSTRACT

A machine for treating a fabric (T) with air, comprises a tunnel (10) for pneumatically transporting the fabric and means for injecting the air into the tunnel above and/or below the fabric and comprising at least one diverting valve (16;18) located substantially half way along the tunnel and having two channels (16*a*,16*b*;18*a*,18*b*) which are oriented to direct the air flow entering the tunnel in one direction or the other. The valve comprises an adjustable baffle (17;19) adapted to shut off access to the channels (16*a*,16*b*;18*a*,18*b*) either wholly or partly. In the treatment method of the invention, the air flow (F;F') entering the tunnel is divided into two unequal components ($F_1$, $F_2$; $F_1'$, $F_2'$) directed towards opposite ends of the tunnel.

16 Claims, 3 Drawing Sheets

(51) Int. Cl.
*F26B 13/10* (2006.01)
*B65H 20/14* (2006.01)

(56) References Cited

U.S. PATENT DOCUMENTS

| | | | | | |
|---|---|---|---|---|---|
| 5,893,933 | A * | 4/1999 | Strahm | ..... | D06C 19/00<br>26/19 |
| 2005/0066694 | A1 * | 3/2005 | Marcora | ..... | D06B 3/28<br>68/12.14 |
| 2007/0266741 | A1 * | 11/2007 | Ciabattini | ..... | D06B 3/28<br>68/5 D |

FOREIGN PATENT DOCUMENTS

| | | | | | |
|---|---|---|---|---|---|
| WO | 2006021978 | A1 | 3/2006 | | |
| WO | WO-2009141841 | A1 * | 11/2009 | ..... | D06B 3/28 |

* cited by examiner

METHOD AND MACHINE FOR TREATING TEXTILE FABRICS WITH AN ADJUSTABLE AIR FLOW

TECHNICAL FIELD

This invention relates to a method and a machine for treating textile fabrics with an adjustable air flow.

PRIOR ART

In the finishing of textile fabrics, it is common practice to use continuous, open-width machines (tumblers) for treating the fabrics to obtain fibre swelling, and a soft pleasant hand for fabrics of all kinds.

These machines comprise a straight air tunnel and at least one flow diverter baffle movable between two limit positions to convey all the air in the tunnel in one direction or the other alternately.

That way, the fabric is transported at high speed towards one or the other of the tunnel openings and transferred alternately to one or the other of the two heaps at the two ends of the tunnel.

Impact grilles suitably positioned in front of the two openings of the transport tunnel bring the fabric to a stop while allowing the air to continue towards two hoods above the heaps.

Systems for slowly transferring the fabric, at production speed, feed the fabric into the first heap and withdraw an equal quantity of it from the second heap.

A machine of the above type is described in WO2006021978A1.

EP2535451A1 describes a continuous machine equipped with a baffle for diverting the air flow in the transport tunnel. The baffle has a third working position where the total horizontal component of the air flow in the tunnel is substantially zero, thus keeping the fabric substantially stationary.

The machine last mentioned, although it allows a lower frequency of fabric impact against the grilles to be obtained, does not allow the intensity of the impact to be reduced without also reducing flow rate and drying speed.

DISCLOSURE OF THE INVENTION

The aim of this invention is to provide a method and a machine for treating textile fabrics with air by means of a system of variable air flow distribution in the fabric transport tunnel.

More specifically, this invention has for an aim to provide a method and a machine where the air flow entering the entering the transport tunnel can be divided adjustably into a larger fraction in one direction and a smaller fraction in the other direction.

In particular, this invention has for an aim to provide a method and a tumbler machine for continuous open-width treatment of a fabric by means of a system of air distribution in the fabric transport tunnel, where the system can work in two distinct operating modes:

- a first, "conventional" mode where the air entering the tunnel is directed all towards one or all towards the other of the two ends of the tunnel, alternately; and
- a second mode where the air flow entering the tunnel is divided alternately into a large component in one direction and a small component in the other direction, the dividing fraction being adjustable.

The above aims are achieved by a method and a machine according to the accompanying independent claims.

The solution proposed allows reducing the intensity of the impact of the fabric against the grilles while maintaining unchanged the total air flow acting on the fabric and without interrupting its alternating motion inside the tunnel.

This meets the strongly felt need to exert less mechanical action on the fabric, that is, to reduce its transport speed and impact force, without reducing the flow rate and hence the fabric drying speed.

These and other advantages, as well as the features of the machine, will be better understood from the following description with reference to the accompanying drawings provided by way of non-limiting example.

EMBODIMENTS OF THE INVENTION

Figure 1:
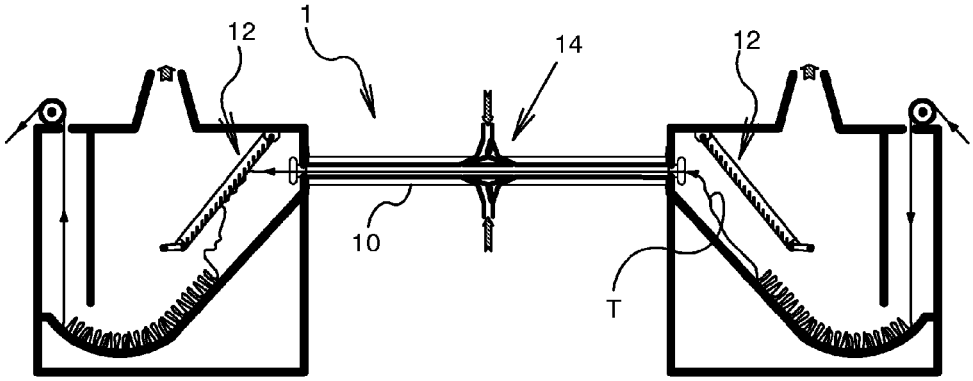
FIG. 1 shows a schematic longitudinal cross section of a continuous open-width tumbler.

FIG. 1 shows the schematic longitudinal cross section of a continuous open-width tumbler 1 which is equipped with a rectangular-section tunnel 10 for pneumatically transporting a fabric T and with impact grilles 12 facing the openings of the tunnel. Located substantially half way along the tunnel 10, typically above and below the fabric, is the system 14 for injecting air into the tunnel. The air flow is generated by means, not illustrated, of essentially known type.

Figure 2:
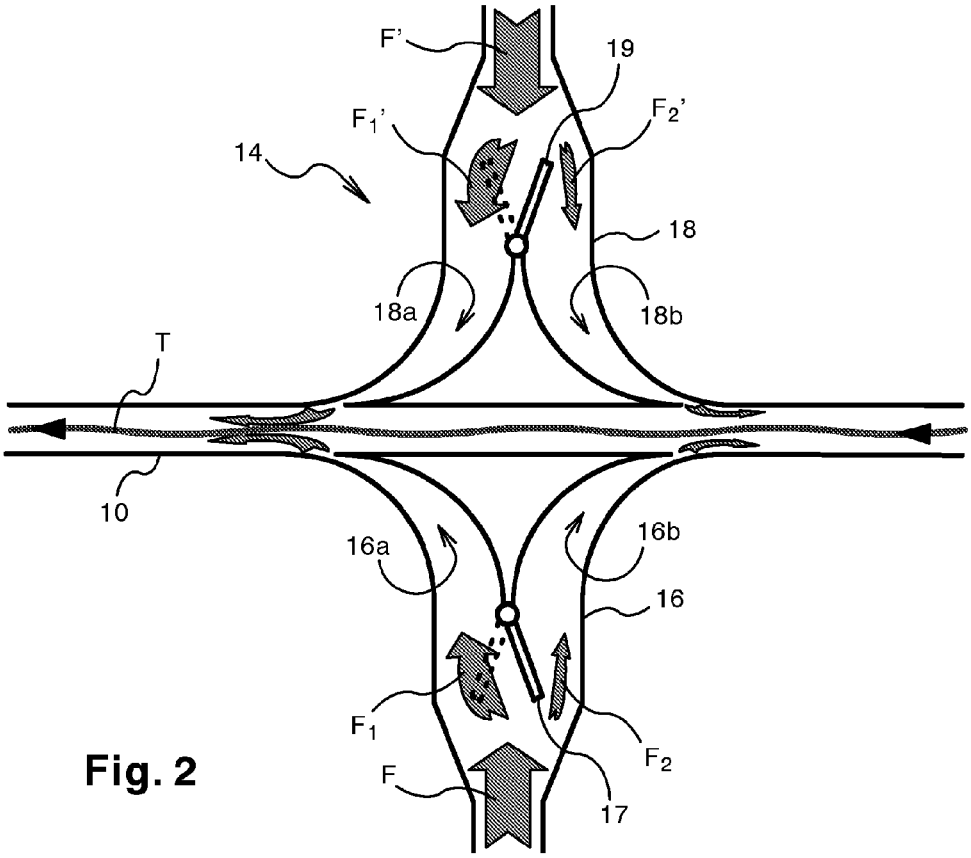
FIG. 2 shows an enlarged schematic cross section of the system of air distribution in the fabric transport tunnel forming part of a tumbler according to the invention.

This system 14—shown enlarged and in more detail in FIG. 2—comprises two diverting valves 16,18, each having two channels 16*a*,16*b* and 18*a*,18*b* which are suitably oriented to direct the air flow entering the tunnel in one direction or the other.

According to the invention, each valve also comprises an adjustable baffle 17,19 adapted to shut off access to the channels 16*a*,16*b* and 18*a*,18*b*, either wholly or partly.

As a result, the valves 16,18 can operate in two distinct modes.

Figure 3A:
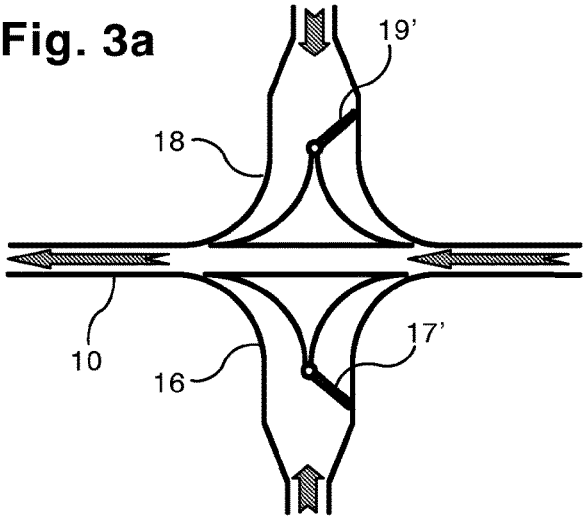
FIGS. 3*a*-3*d* illustrate the four operating configurations of the distribution system of FIG. 2.
Figure 3B:
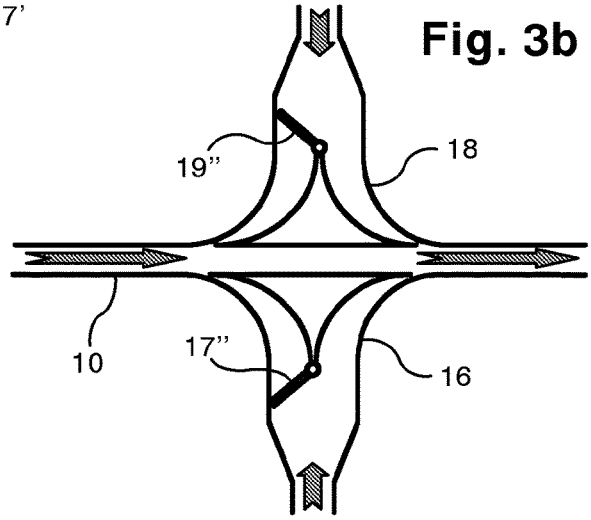
Figure 3C:
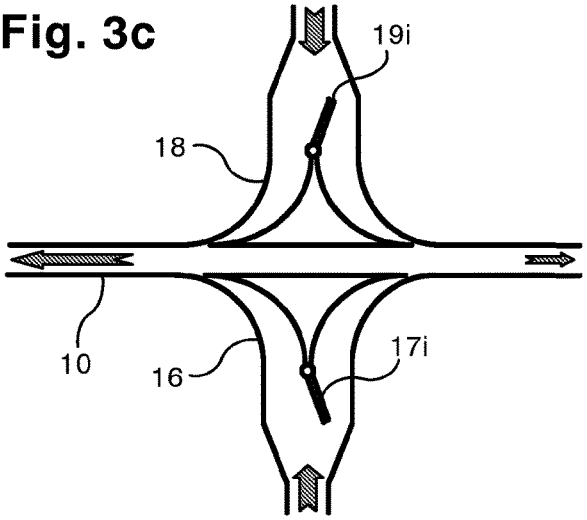
Figure 3D:
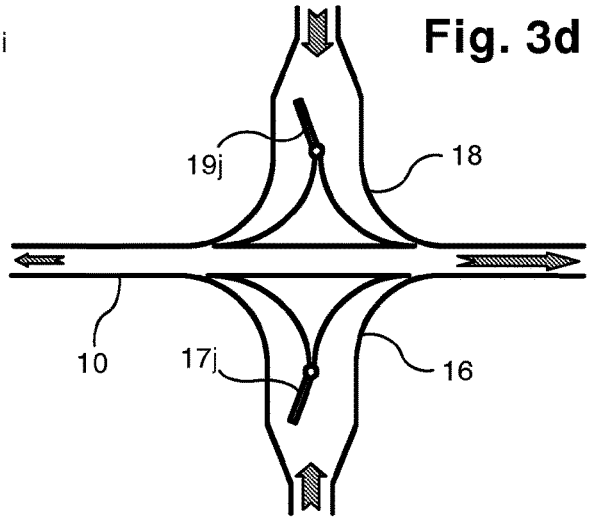

In effect, each baffle 17 (19) can alternately adopt two limit positions 17',17" (19',19"), illustrated in FIGS. 3*a*,3*b*, or two intermediate positions 17*i*,17*j* (19*i*,19*j*) between the limit positions and illustrated in FIGS. 3*c*,3*d*.

In the first case, in each cycle, each of the two channels 16*a*,16*b* (18*a*,18*b*) is completely shut off, thereby causing all the air flowing into the tunnel to be diverted in one direction or the other. This is the traditional mode of operation of the state of the art which provides the maximum speed and force of fabric transport but not the maximum drying capacity, as will become clearer as this description continues.

In the second case (illustrated in more detail in FIG. 2), in each cycle, each of the two channels 16*a*,16*b* (18*a*,18*b*) is shut off only partly, causing the air flow F (F') to be divided into two unequal components, one $F_1$ ($F_1'$) larger, which is directed through the channel left totally open by the baffle 17 (19) towards one end of the tunnel, and one $F_2$ ($F_2'$) smaller, which is directed through the channel partly closed by the baffle towards the other end of the tunnel.

In this operating mode, the resultant force by which the fabric is transported by the air is obviously directed in the direction of the larger flow component, with an intensity equal to the difference between the forces exerted by the two components.

The mechanical transport and impact action on the fabric is therefore proportional to the difference between the above described flow components.

Conversely, in this operating mode, the drying action on the fabric is at its maximum and is proportional to the sum of the air flows in both directions.

Advantageously, in this operating mode, the ratio $F_2/F_1$ ($F_2'/F_1'$) of the smaller flow component to the larger flow component is between 0.2 and 0.8, that is, between 20% and 80%.

In a preferred embodiment, the total air flow entering from above the fabric is different from the total air flow entering from below the fabric. Further, the top flow also differs from the bottom flow in that the oppositely directed flows are divided by a different percentage.

A continuous open-width tumbler may usefully be constructed in such a way as to allow it to work simultaneously in both of the operating modes described, at the user's discretion, so that it can be used for treating different fabrics and/or for different process needs.

The diverting valves must in this case be able to adopt four different configurations:

two with the baffles at the limit positions, alternately with each other, for the operating mode with total flow diversion;

two with the baffles at the intermediate positions, again alternately with each other, for the operating mode with partial flow diversion and asymmetric flow division.

Figure 4:
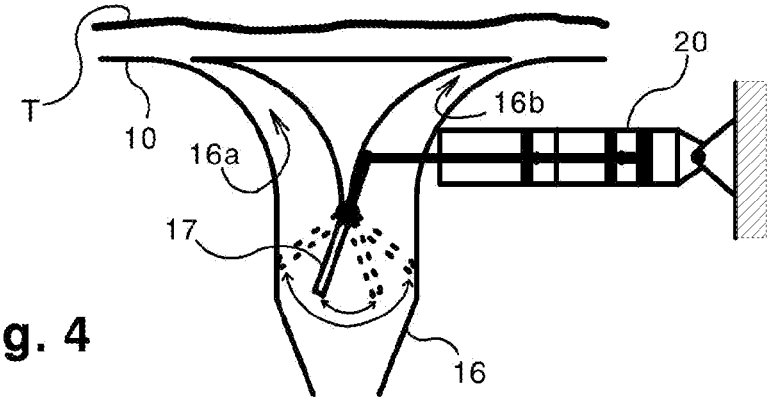
FIG. 4 illustrates an example of a device for controlling one of the valves forming part of the distribution system.

To achieve these four configurations, each valve is advantageously driven by a pneumatic, four-position actuator, for example a pneumatic cylinder 20 with three different chambers in series, of a type readily available on the market (see FIG. 4).

Figure 5:
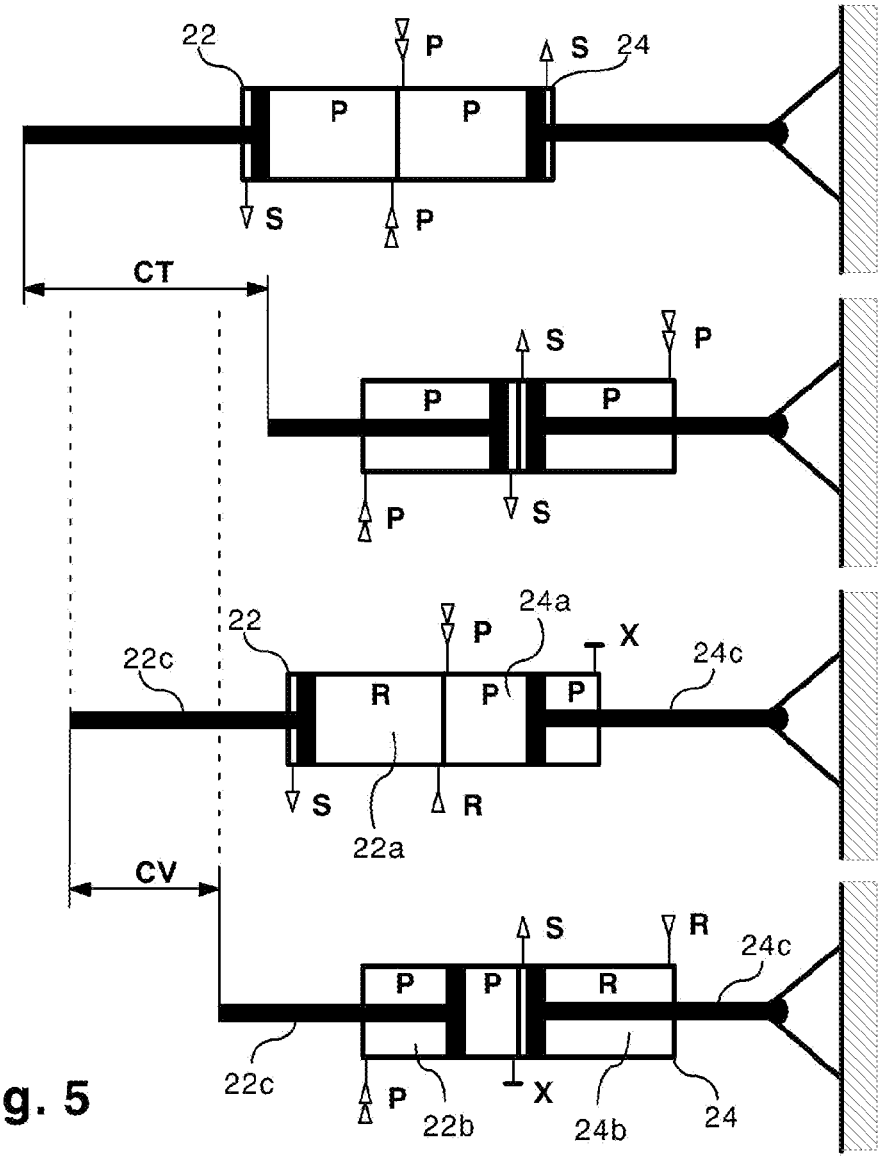
FIG. 5 illustrates an advantageous system for controlling the valves forming part of the distribution system.

In a preferred embodiment of the invention, illustrated in FIG. 5, the two intermediate positions of each baffle may be varied according to different process needs. For this purpose, for each valve, two pneumatic cylinders 22,24 are provided, mounted opposite each other and supplied with compressed air at two different pressures: one, labelled "P", is fixed and used for normally supplying the pneumatic system; and the other, labelled "R", is suitably reduced to user-selectable values.

By suitably supplying the four chambers of the pair of cylinders, the cylinders can be set to four different stroke values, two of which are the end limit values and two are intermediate values. The latter vary according to the values assigned to the reduced pressure "R".

In other words, the operator can choose whether to make the cylinder pistons travel the total forward-return stroke "CT", illustrated by the configurations (a) and (b) of FIG. 5, or a partial forward-return stroke "CV", illustrated by the configurations (c) and (d) of FIG. 5, variable in length as a function of the reduced pneumatic pressure "R".

To better understand the operation of the pneumatic actuator, the letter "S" denotes exhausting and the letter "X" shutoff of the ports indicated.

As schematically illustrated by the configurations (c) and (d) of FIG. 5, to obtain a partial forward-return stroke of the pistons, the actuator works according to the following steps:

alternately filling at reduced pressure "R" the chamber 22*a* on the cylinder side of the first cylinder 22, whose piston drives the valve baffle, and the chamber 24*b* on the rod side of the second cylinder 24, shutting off the intake of the chamber 22*a* (24*b*) and filling the chamber 22*b* on the rod side of the first cylinder 22, or the chamber 24*a* on the cylinder side of the second cylinder 24, at full pressure "P" in such a way as to drive the piston 22*c* (24*c*) inside the cylinder 22 (24) until bringing pressures to equilibrium at the supply value "P", the lower the reduced pressure "R", the longer the movement of the piston because the piston has to travel a longer compression stroke distance.

It is evident that with two actuators operating in the manner described above, the movements of the baffles 17,19 can be adjusted independently of each other, which in turn means that it is possible to regulate the air flow intensity above and below the fabric as needed and independently of each other.

The possibility of regulating the air flow in one direction in a variable ratio to the simultaneous air flow in the other direction means that the fabric can be transported through the air process tunnel at speeds which can be adjusted between the maximum value and lower, more limited values.

That means the fabric drying speed—which is approximately proportional to the total quantity of hot air entering the process tunnel—can be made independent of the frequency and intensity of fabric impacts on the grilles, on which the intensity of the fabric softening and swelling treatment depend directly.

The latter possibility can lead to important technological applications in continuous tumbler machines that are very widely used for processing a large variety of fabrics, each having different requirements, often very different from each other.

Finally, when the alternating movement of the fabric in the tunnel is not accomplished at the same speed, or in the same times, when it is transferred in either direction, it is possible to act in order to vary these times up to make them equal or even different at will.

This is advantageously obtained by differentiating appropriately between them the values of the reduced pressure "R" when the tissue goes in one direction than when it goes in the opposite direction, either with manual settings or with automatic control systems.

In this case, in practice, the movement of the deflector (17 or 19) of the valve will no longer be symmetrical with respect to the centreline of the valve itself, but conveniently asymmetric.

This possibility can be very useful, for example, to remedy particular behaviours of the fabric and/or to compensate any geometrical dissymmetry of the tunnel.

The invention claimed is:

1. A machine for treating a textile fabric with air, the machine comprising:

a tunnel for pneumatically transporting the, textile fabric, the tunnel comprising openings;

impact grilles facing the openings of the tunnel;

a means for injecting the air into the tunnel above and/or below the textile fabric and the means for injecting the air comprising at least one diverting valve located substantially half way along the tunnel and the means for injecting the air having two channels which are oriented to direct air flow entering the tunnel in one direction or the other another direction, the at least one diverting valve comprising an adjustable baffle adapted to shut off access to each of the two channels wholly and configured to partly shut one of the two baffles and simultaneously partly shut another of the two baffles, thereby dividing the air flow into two unequal components with a flow from the one channel, directed towards one end of the tunnel, being larger and a flow from the other channel, directed in an opposite direction towards another end of the tunnel, being smaller.

2. The machine according to claim 1, wherein the adjustable baffle can alternately adopt two limit positions, or two intermediate positions between the two limit positions.

3. The machine according to claim 2, wherein the adjustable baffle is driven by a pneumatic, four-position actuator.

4. The machine according to claim 2, wherein the adjustable baffle is driven by a pair of pneumatic cylinders, said pair of pneumatic cylinders being mounted opposite each other and supplied with compressed air at two different pressures, one fixed and one reduced to values settable as required.

5. The machine according to claim 1, wherein the adjustable baffle is driven by a pneumatic, four-position actuator.

6. The machine according to claim 1, wherein the adjustable baffle is driven by a pair of pneumatic cylinders, said pair of pneumatic cylinders being mounted opposite each other and supplied with compressed air at two different pressures, one fixed and one reduced to values settable as required.

7. A method for treating a textile fabric with air, the method comprising:

providing a machine for treating a textile fabric with air, the machine comprising a tunnel for pneumatically transporting the, textile fabric, the tunnel comprising openings, impact grilles facing the openings of the tunnel and a means for injecting the air into the tunnel above and/or below the textile fabric and the means for injecting the air comprising at least one diverting valve located substantially half way along the tunnel and the means for injecting the air having two channels which are oriented to direct air flow entering the tunnel in one direction or the other another direction, the at least one diverting valve comprising an adjustable baffle adapted to shut off access to one of the two channels wholly and configured to partly shut one of the two baffles and simultaneously partly shut another of the two baffles, thereby dividing the air flow into two unequal components with a flow from the one channel, directed towards one end of the tunnel, being larger and a flow from the other channel, directed in an opposite direction towards another end of the tunnel, being smaller;

transporting the textile fabric inside the tunnel against facing impact grilles by means of at least one alternating air flow entering the tunnel substantially half way along the tunnel; and with the adjustable baffle, dividing the at least one alternating air flow into two unequal flow components, the two unequal flow components comprising one larger flow component and one smaller flow component, the one larger flow component being directed towards the one end of the tunnel, and the one smaller flow component being directed in an opposite direction towards the other end of the tunnel.

8. The method according to claim 7, wherein a ratio of the one smaller flow component to the one larger flow component is adjustable.

9. The method according to claim 8, wherein the ratio of the one smaller flow component to the one larger flow component is between 0.2 and 0.8.

10. The method according to claim 9, wherein a first air flow enters the tunnel above the fabric and a second air flow enters under the fabric, the first air flow differing from the second air flow by a different percentage division of the first air flow and the second air flow in two opposite directions.

11. The method according to claim 8, wherein a first air flow enters the tunnel above the fabric and a second air flow enters under the fabric, the first air flow differing from the second air flow by a different percentage division of the first air flow and the second air flow in two opposite directions.

12. The method according to claim 8, wherein the ratio of the one smaller flow component to the one larger flow component is between 20% and 80%.

13. The method according to claim 7, wherein a first air flow enters the tunnel above the fabric and a second air flow enters under the fabric, the first air flow differing from the second air flow by a different percentage division of the first air flow and the second air flow in two opposite directions.

14. The method according to claim 13, wherein the first air flow above the fabric and the second air flow under the fabric are variable in intensity and independently of each other.

15. The method according to claim 14, wherein a total air flow entering from above the fabric is different from a total air flow entering from below the fabric.

16. The method according to claim 13, wherein a total air flow entering from above the fabric is different from a total air flow entering from below the fabric.

* * * * *